US008393931B2

(12) United States Patent
Koball et al.

(10) Patent No.: US 8,393,931 B2
(45) Date of Patent: Mar. 12, 2013

(54) SYSTEM AND METHOD FOR REDIRECTING SMOKE EFFECTS IN A MODEL VEHICLE

(75) Inventors: Bruce R. Koball, Berkely, CA (US); Richard James Mosher, Memphis, MI (US); John T. Ricks, Taylor, MI (US); Tyler R. Brooks, Dearborn, MI (US)

(73) Assignee: Lionel L.L.C., Chesterfield, MI (US)

( * ) Notice: Subject to any disclaimer, the term of this patent is extended or adjusted under 35 U.S.C. 154(b) by 577 days.

(21) Appl. No.: 12/488,373

(22) Filed: Jun. 19, 2009

(65) Prior Publication Data

US 2010/0323578 A1 Dec. 23, 2010

(51) Int. Cl.
*A63H 19/14* (2006.01)

(52) U.S. Cl. ..... 446/25

(58) Field of Classification Search ..... 446/24, 446/25

See application file for complete search history.

(56) References Cited

U.S. PATENT DOCUMENTS

| | | | | |
|---|---|---|---|---|
| 3,234,357 | A * | 2/1966 | Seuthe | 392/403 |
| 3,706,182 | A * | 12/1972 | Sargent | 96/55 |
| 4,744,305 | A * | 5/1988 | Lim et al. | 104/52 |
| 2003/0019979 | A1 * | 1/2003 | Wolf et al. | 246/187 A |
| 2005/0227575 | A1 * | 10/2005 | Pierson | 446/93 |

* cited by examiner

*Primary Examiner* — Gene Kim
*Assistant Examiner* — Amir Klayman
(74) *Attorney, Agent, or Firm* — O'Melveny & Myers LLP

(57) ABSTRACT

A system and method is provided for selectively directing smoke in a model train or other model vehicle. In one embodiment, a directional fan is used to guide smoke to one of at least two output ports. When the fan is rotated in a first direction, air is drawn in through a first port and smoke is directed out of a second port. When the fan is reversed, the flow of air is reversed to draw air in through the second port and to direct smoke out through the first port. In another embodiment, multiple blower units are connected to a common smoke generating unit and can be selectively operated to direct smoke to plural locations within a model vehicle. The volume an speed of smoke can be variably controlled, and audio effects can be synchronized with smoke visual effects for added realism.

11 Claims, 13 Drawing Sheets

SYSTEM AND METHOD FOR REDIRECTING SMOKE EFFECTS IN A MODEL VEHICLE

BACKGROUND OF THE INVENTION

1. Field of the Invention

The present invention relates to visual effects employed in model vehicles and, more particularly, to a system and method for generating smoke and selectively directing it to different locations to create realistic visual effects.

2. Description of Related Art

Model vehicles, such as model train engines, that have smoke-generating devices are well known in the art. Some smoke generating devices generate smoke that drifts out of a smokestack to simulate the smoke produced from the burning of fuel, such as coal or wood. Other model vehicles may use a smoke generator to simulate steam escaping from valves or cylinders. More sophisticated models may use a blower fan coupled with a smoke-generating device in order to force puffs of smoke out of an opening to achieve increased realism, and still others may include multiple openings such that smoke is blown out of several orifices at once to simulate both smoke and steam.

However, current model-train smoke generation systems lack some realism in that they are unable to easily direct smoke to particular locations under user command in order to simulate particular operating conditions. For example, when an actual steam locomotive first starts up, valves called cylinder cocks are opened to allow accumulated water to drain that might otherwise damage pistons. The open cylinder cocks allow large quantities of steam to escape from the cylinders of the locomotive until the cylinders are clear and the engineer closes the cylinder cocks. During subsequent operation of the locomotive, steam escaping from the cylinders would indicate improper operation or a leaky valve and would be undesirable.

Thus, to provide more realism in a model vehicle system, it would be desirable to first direct smoke from a smoke-generation unit to the vicinity of the locomotive wheels to simulate start-up conditions and to later direct smoke to the locomotive smokestack while preventing it from escaping from the cylinders. At other times, it may be desirable to direct smoke to a whistle device to simulate a steam whistle. Such control and direction of smoke from a smoke generating unit could be achieved by actuating motorized valves, but such an implementation would add complexity and potentially reduce the reliability of the model vehicle system. Thus, it would be advantageous to provide a system and method for directing smoke that overcomes the foregoing drawbacks.

SUMMARY OF THE INVENTION

The present invention provides a system and method for selectively directing smoke within a model vehicle, such as a model train engine or model train car, either by reversing the direction of a bi-directional blower fan or by selectively operating one or more blower fans connected to a common smoke box. In one embodiment of a smoke-generating system in accordance with the present invention, an enclosure is adapted to include at least a first port and a second port, each of which allows air and/or smoke to enter and exit the enclosure. The enclosure may further include a smoke-generating device comprising a heating element and a wick element. An oil or other volatilizable material may be applied to the wick element such that when an electrical current is applied to the heating element, the material volatizes, producing smoke. The wick element may comprise rock wool, fiberglass, or any other material suitable for holding fuel and generating smoke. The enclosure further comprises a bi-directional fan such that rotation of the fan in a clockwise direction causes air to move in a first direction, and rotation of the fan in a counter-clockwise direction causes air to flow in a second, substantially opposite direction. The fan is coupled to a motor that is capable of selectively driving the fan in a clockwise or counter-clockwise direction. The direction of the fan may be controlled by switching the motor using a manual switch or may be controlled by a remote-control device. Further, in order to control the amount of smoke pushed through a selected port, the speed of the fan may be controlled by controlling the speed of the motor driving the fan. For example, a user may actuate a variable control interface device such as a control knob or a slider, either locally or remotely, in order to control the speed of the motor driving the fan that is desired to be controlled. When the fan is operated at high speed, a large volume of smoke may be directed out of the selected port. When the fan is operated at low speed, a lower volume of smoke may be directed out of the selected port. Alternatively, the control knob or slider may control the amount of current that is supplied to the heating element and thereby control the amount of smoke produced. For example, a slider may be moved a large distance to supply a large amount of current to the heating element, causing a high temperature to be achieved that creates a large volume of smoke. Alternatively, the slider may be moved a short distance, causing a small amount of current to be provided to the heating element, thereby causing less heating and a correspondingly lower volume of smoke to be produced. Other embodiments may use a combination of heater current control and fan speed control to affect the amount of smoke produced. Of course, control devices other than knobs or sliders may also be used to control the volume of smoke, including digital controllers and other devices known in the art.

In one embodiment, when the fan is rotated in a clockwise direction, air is pulled into a first port, and smoke is directed out of a second port. When the fan is rotated in a counter-clockwise direction, air is pulled into the second port, and smoke is directed out of the first port. In another embodiment of a smoke-generating system in accordance with the present invention, the enclosure further includes a third port including a check valve, allowing air to flow into the enclosure through the third port but preventing air from exiting the enclosure through the third port. When the fan is rotated in a first direction, the check valve of the third port may open, allowing the third port to serve as the primary air intake port. When the direction of the fan is reversed, the check valve will seal, preventing smoke from exiting through the third port. Of course, the invention is not limited to embodiments having two or three ports. Four or more ports may also be provided in order to direct smoke to multiple destinations within the model vehicle, and such embodiments would also fall within the scope and spirit of the present invention.

In still another embodiment, the enclosure includes at least one baffle wall dividing the enclosure into two portions, one of which contains the smoke-generating device and the other of which contains the fan. The baffle walls include openings that allow air to pass between the first and second portions of the enclosure. The use of baffle walls may improve the directional flow of air within the enclosure and may allow smoke to be more effectively directed to selected ones of the two or more ports.

In another embodiment of a smoke-generating system in accordance with the present invention, a first port of the enclosure is connected to a smokestack of the model vehicle in order to provide a visual effect simulating smoke emanating from a real locomotive smokestack. A second port may be connected to a tube adapted to direct smoke to another location within the model vehicle. For example, the tube may direct smoke to the vicinity of the wheels of the model vehicle to simulate clearing of the cylinders as a steam train starts up. Smoke may also be directed to a model steam whistle to simulate the operation of an actual locomotive steam whistle. Of course, smoke may also be directed to other locations, and such systems would also fall within the scope and spirit of the present invention. It should further be appreciated that additional ports could be provided in order to direct smoke to multiple locations, such as to a smokestack, to a steam whistle, and to the wheel cylinders, and such embodiments would also fall within the scope and spirit of the present invention.

In an alternative embodiment of a smoke-generating system in accordance with the present invention, a common smoke box is connected to a plurality of blower units, each having its own fan. When the fan within a blower unit is energized, smoke is drawn from the smoke box to that particular blower unit. The blower unit includes an output port that may be connected to a model vehicle feature, such as a smokestack, to create a visual smoke effect. Each blower unit further includes a motor coupled to the fan within the blower unit. This enables each of the blower units to operate independently of one another to selectively direct smoke to multiple locations within a model vehicle. The motors of multiple blower units may also be operated simultaneously to direct smoke to plural locations at the same time. The motors connected to the fans of the blower units may be variably controlled as described above using a local or remote variable control device, such as a knob or slider, such that the speed of the motors can be varied to deliver more or less smoke as desired.

In one embodiment, the multiple blower units are mechanically separated units such that each has its own enclosure, fan, and motor. In another embodiment, two or more blower units may be mechanically integrated into a single enclosure that nevertheless provides separate chambers for each of the fans such that smoke can be directed through each blower unit individually. Although the embodiments presented herein generally comprise two blower units, systems falling within the scope and spirit of the present invention may also comprise a single blower unit. Similarly, systems employing three or more blower units connected to a common smoke box would fall within the scope of the present invention.

The common smoke box may have multiple output ports such that an independent blower unit is connected to each one of the multiple output ports. Alternatively, the smoke box may have a single output port, and a tubing assembly including one or more junctions, such as T-junctions or Y-junctions, may be used to connect the one output port to multiple blower units.

In a particular embodiment of a smoke generating system in accordance with the present invention, the model vehicle is a model train engine. A smoke box is connected to three independently controlled blower units. The first blower unit has an output port that is connected to a smokestack of the model train engine such that smoke puffs exiting the smokestack can be simulated. The second blower unit has an output port that is connected to a steam whistle in order to simulate the operation of an actual locomotive steam whistle. The third blower unit has an output port that is directed to a location near the wheels of the model train engine in order to simulate steam escaping from the cylinders during cylinder clearing operations. Of course, other combinations and arrangements of the smoke generating system are possible. It should be appreciated that these other arrangements and embodiments of the system disclosed herein would also fall within the scope and spirit of the present invention.

A more complete understanding of a system and method for directing the flow of smoke within a model vehicle will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention provides a system and method for controlling and directing smoke in a model vehicle such as a model train engine or a model train car. In the detailed description that follows, like element numerals are used to describe like elements illustrated in one or more figures.

Figure 1:
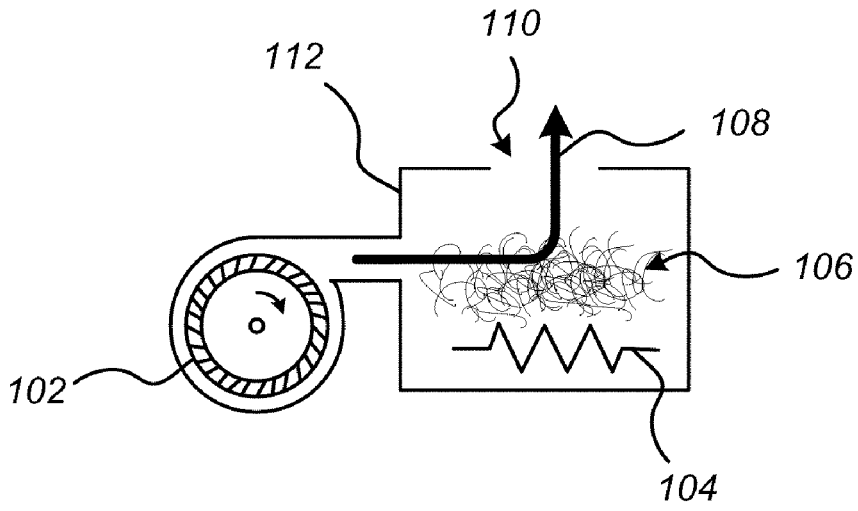
FIG. 1 PRIOR ART
FIG. 1 illustrates a smoke-generating system having a unidirectional blower, typical of the prior art.

Model vehicles having smoke-generating devices are generally known in the art. For example, FIG. 1 illustrates a traditional smoke generating system comprising an enclosure 112 containing a wick material 106, such as fiberglass or rock wool, and a heating element 104. An oil or other smoke-generating substance is applied to the wick material 106, and when electrical current is applied to the heating element 104, the oil in the wick 106 burns, producing smoke. A blower 102, typically comprising a centrifugal fan, directs air through or over the wick material 106, and out through an opening 110 in the enclosure 112. The stream of air from the blower 102 pushes the smoke along the path indicated at 108, creating a visual smoke effect. In this smoke-generating system, typical of the prior art, reversing the direction of the centrifugal fan will not change the direction of the air flow (though it may be slightly less efficient in moving the smoke).

Figure 2:
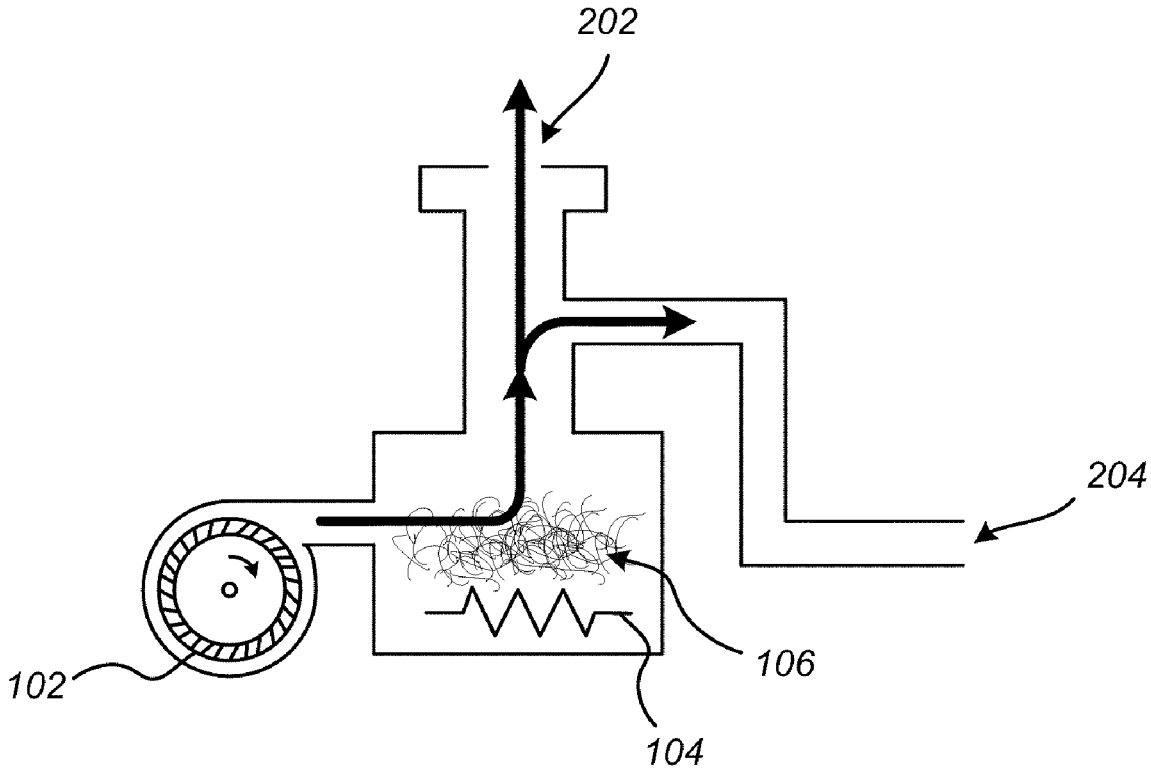
FIG. 2 PRIOR ART
FIG. 2 illustrates an alternative embodiment of a smoke-generating system typical of the prior art.

If it is desired to direct smoke to more than one device within the model vehicle, a smoke generation system typical of the prior art might include the addition of an auxiliary branch, or second opening, coupled to the same smoke unit. For example, the system shown in FIG. 2 depicts a blower fan 102 pushing smoke through both a smokestack 202, and though an auxiliary opening 204, which might be located near the wheels of the train, or in any other location where it is desired to produce a visual smoke effect. As is evident from FIG. 2, a disadvantage of such a system is the inability to selectively control the direction of the smoke or to select which of the two openings, 202 and 204, will emit smoke.

Figure 3:
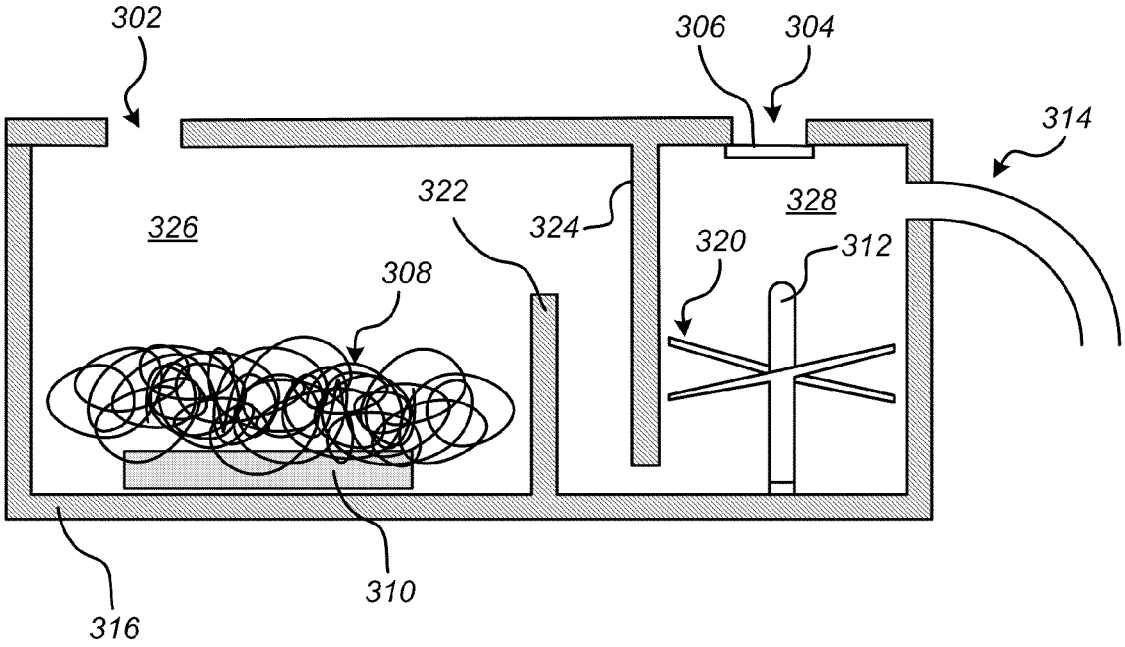
FIG. 3 illustrates an embodiment of a smoke-generating system in accordance with the present invention.

An embodiment of a smoke generation system in accordance with the present invention is depicted in FIG. 3. A housing 316 encloses a quantity of wick material 308, such as rock wool, located in close proximity to a heating element 310. An oil or other volatizable material is applied to the wick material 308 such that when the heating element is energized, the material volatizes, creating smoke. The enclosure 316 includes one or more baffles 322, 324 dividing the enclosure into a first region 326 including the wick material 308 and heating element 310, and a second region 328, including a propeller fan 312. The propeller fan 312 includes directional blades 320 such that rotation of the fan 312 in a first direction causes a downward flow of air, and rotation of the propeller 312 in a second direction causes an upward flow of air. The top of the first region 326 includes a port 302 that is normally operated as a smoke output port and that may be coupled to the model train smokestack. The second region 328 includes a port 304 that is normally used as an air input port. The air input port 304 includes a check valve 306 that prevents air from being exhausted from the enclosure 316 out through the air input port 304. The check valve may comprise a thin sheet of plastic or other material attached at one edge to the inside wall of the enclosure 316. The smoke generation system also includes an auxiliary port 314 that provides a path for smoke that is directed to an alternate location, such as to pistons near the wheels of the model train locomotive.

Figure 4:
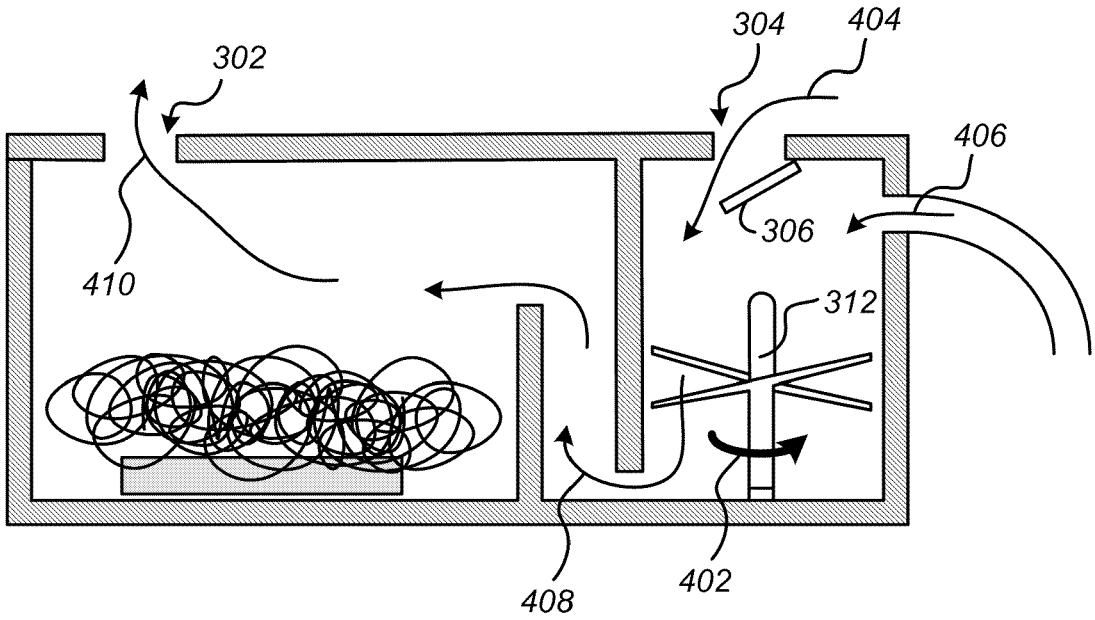
FIG. 4 illustrates a first mode of operation of the embodiment of FIG. 3.

FIG. 4 illustrates the embodiment of FIG. 3 operated in a first mode in which the fan 312 is rotated in a first direction 402 in order to pull air in through the air input port 304. The rotation of the propeller 312 pulls the air in a downward direction 404. The motion of the air causes the check value 306 to open, allowing air to enter the enclosure. The rotation of the propeller 312 may also cause some air to be pulled into the enclosure through the auxiliary port as shown at 406. The air is forced around the baffles as indicated at 408 and through the first region containing the wick material and heating element. It is then forced out of the smoke output port 302, as indicated at 410, which is typically connected to the model vehicle smokestack, although other configurations are possible. The motion of air through the enclosure as indicated will direct the smoke out of the smoke output port 302, creating a visual effect.

Figure 5:
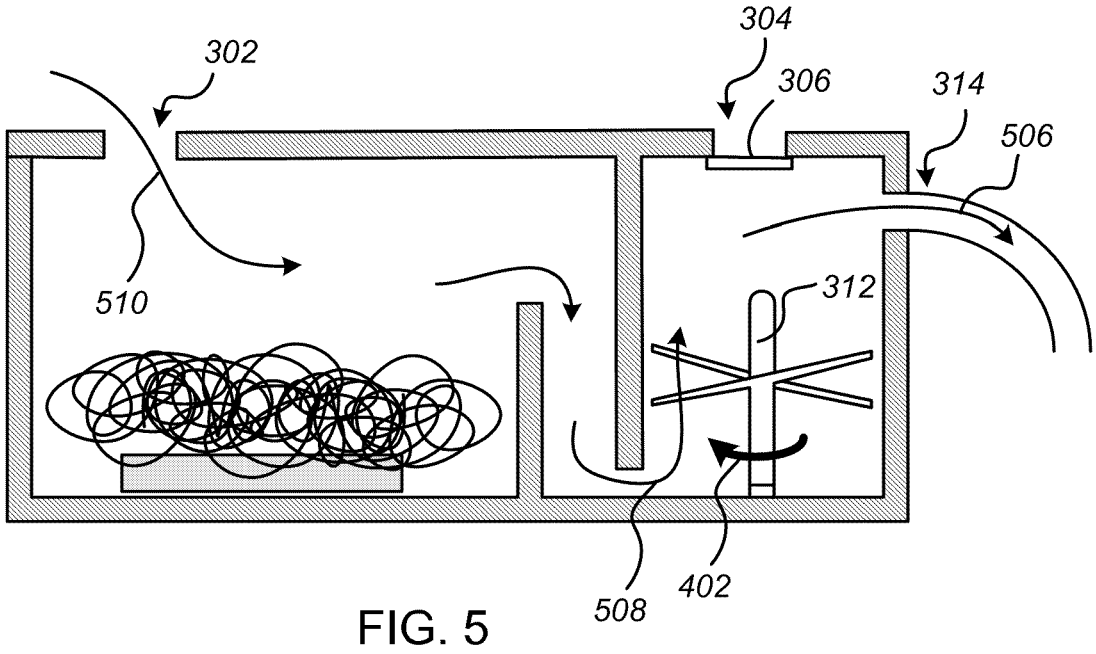
FIG. 5 illustrates a second mode of operation of the embodiment of FIG. 3.

FIG. 5 illustrates the embodiment of FIG. 3 operated in a second mode in which the fan 312 is rotated in a reverse direction that pushes air in an upward direction indicated at 508. The upward flow of air causes the check value 306 to close, preventing air or smoke from exiting through the air intake port 304. Instead, air is drawn into the enclosure through the smoke output port 302, as indicated at 510. It is then forced out of the enclosure through the auxiliary port 314 as indicated at 506, and may be directed to other locations within the model vehicle, such as to pistons near the wheels of the model locomotive.

Figure 6:
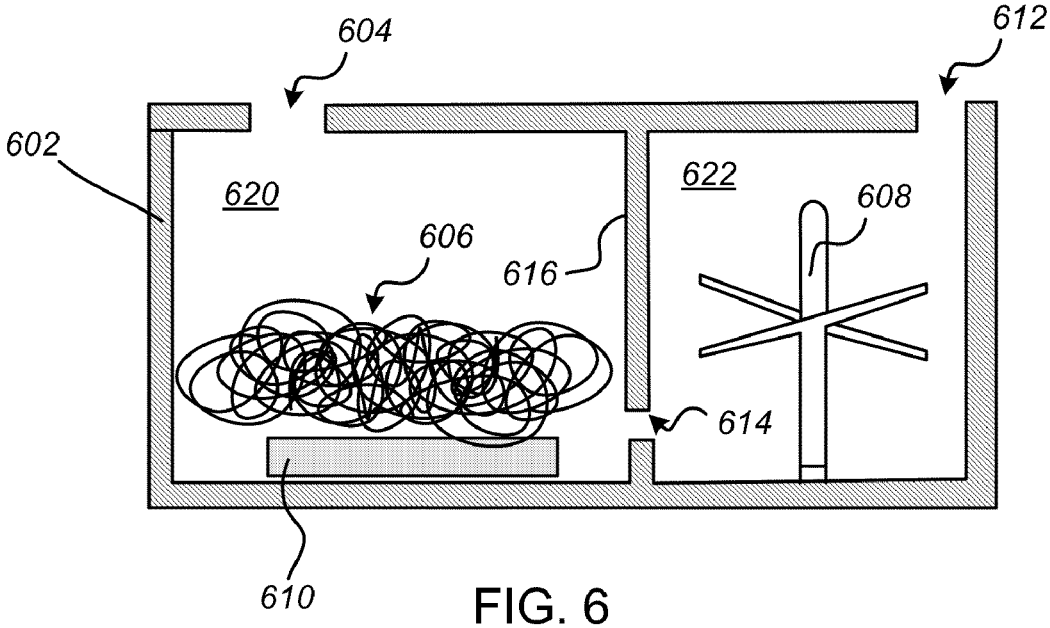
FIG. 6 illustrates an alternative embodiment of a smoke-generating system in accordance with the present invention.
Figure 7:
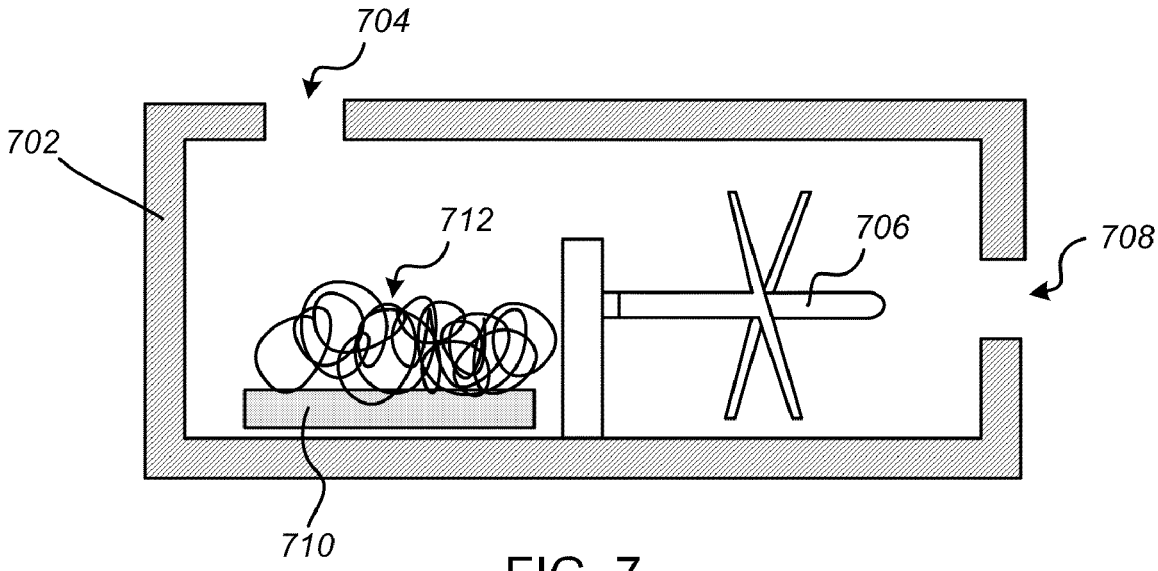
FIG. 7 illustrates an additional alternative embodiment of a smoke-generating system in accordance with the present invention.

The embodiment depicted in FIGS. 3-5 is only one possible embodiment of a smoke unit in accordance with the present invention. Other configurations are also possible and would fall within the scope and spirit of the present invention. For example, FIGS. 6 and 7 depict alternate embodiments of a smoke unit in accordance with the present invention. In FIG. 6, an enclosure 602 includes a heating element 610 in contact with wick material 606 and configured such that when the heating element 610 is energized, oil applied to the wick material 606 will volatize, creating smoke. A partition wall 616 divides a first region 620 containing the heating element 610 and wick material 606 from a second region 622 containing a directional fan 608. The partition wall 616 includes a hole or slot 614 to allow air to move from the first region 620 to the second region 622. When the fan 608 is rotated in a first direction, air is drawn in through a first port 612 and directed through the hole 614 in the partition wall 616 and then out through a second port 604, along with smoke produced by the wick 606 and heating element 610. When the fan 608 is rotated in a second opposite direction, air is instead drawn in through the second port 604, is pulled through the hole 614, and is pushed out through the first port 612. In this manner, reversing the direction of the fan 608 will cause smoke to be selectively directed to one of a first port 612 and a second port 604. It should be noted that compared to the embodiment depicted in FIG. 3, the embodiment of FIG. 6 does not include a check valve, but instead relies on the auxiliary smoke output as an air input when the fan is rotated in the appropriate direction. This configuration may be advantageous when space is limited and when smoke emitted from the auxiliary port does not have to be directed a long distance away. When smoke from the auxiliary port is directed a long distance away, the flow resistance of the guide tube may be high enough that the embodiment of FIG. 3 is preferable to assure sufficient air flow when smoke is directed to the primary output port.

FIG. 7 depicts still another embodiment of a smoke unit in accordance with the present invention. In this embodiment, an enclosure 702 includes a heating element 710 and wick material 712 configured to generate smoke as described previously. A fan 706 is oriented as shown in the figure such that when it is rotated in a first direction, air is pulled in through a first port 708 and is directed out through a second port 704. When the fan 706 is rotated in a second direction, air is instead drawn in through the second port 704 and is pushed out through the first port 708. In this manner, reversing the direction of the fan 706 will selectively cause smoke to exit either the first port 708 or the second port 704.

Figure 8:
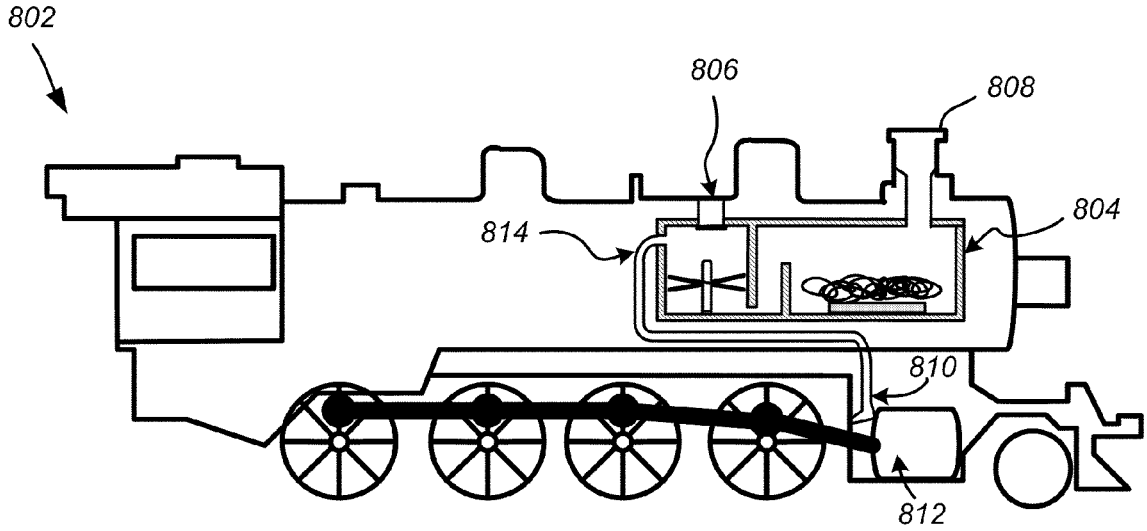
FIG. 8 is a drawing of an embodiment of a smoke-generating system in accordance with the present invention installed within a model train engine.

FIG. 8 depicts an embodiment of a smoke unit in accordance with the present invention located within a model vehicle. A model train engine 802 includes an embodiment of a smoke unit 804. The smoke unit 804 is located within the model train engine 802 such that a smoke output port is connected to the locomotive smokestack 808. When the fan inside the smoke unit is rotated in a first direction, air is pulled into the smoke unit through opening 806, is forced through the baffles and out through the model vehicle smokestack 808, carrying the smoke with it. When the fan is rotated in a second direction, air is drawn into the smoke unit through the smokestack 808, is pulled through the baffles, and is pushed out of the auxiliary port 814. The auxiliary port is connected to a tube that directs the air and smoke to an auxiliary outlet 810 to simulate steam escaping from a drive piston 812. The configuration depicted in FIG. 8 is just one possible configuration of a smoke unit inside a model vehicle. Many other configurations are possible that would take advantage of the two selectable smoke output ports provided by the smoke unit. Such configurations would also fall within the scope and spirit of the present invention.

Figure 9:
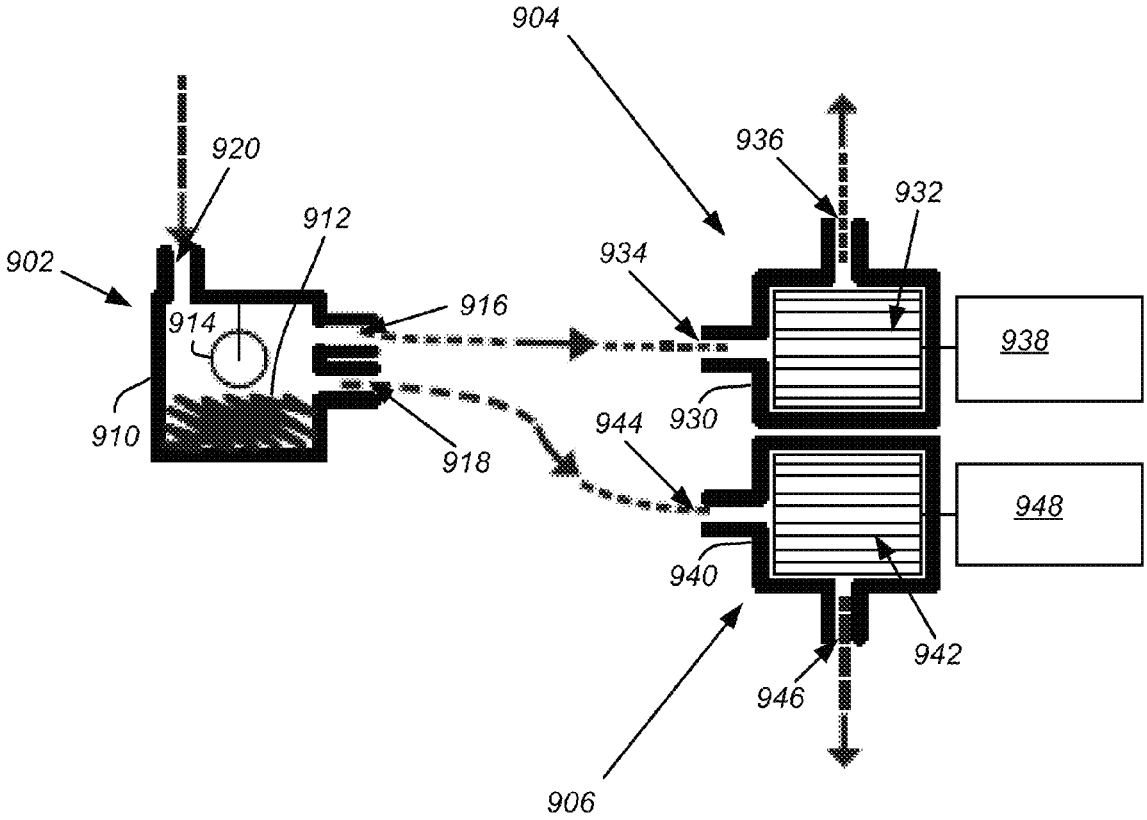
FIG. 9 depicts an alternative embodiment of a smoke-generating system including a single smoke box with two output ports connected to two blower units that are mechanically connected together.

In an alternative embodiment of the present invention, selectively routing smoke to plural locations within a locomotive is achieved by operatively coupling plural blower assemblies to a common smoke box. For example, FIG. 9 depicts an embodiment in accordance with the present invention in which a smoke box 902 is connected to a first blower assembly 904 and a second blower assembly 906. The smoke box 902 comprises a housing 910 having an air input port 920 and smoke output ports 916 and 918. A wick material 912 including a volatizable material is situated within the housing 910, and a heating element 914 is provided such that when the heating element 914 is energized, the volatizable material on the wick 912 will volatize and produce smoke. The heating element 914 may comprise a resistive winding that produces heat when electrical current is run through the winding. In this embodiment, the first smoke box output port 916 is connected to the input port 934 of a first blower assembly 904. The first blower assembly 904 includes a housing 930 enclosing a fan 932. A motor 938 is coupled to the fan 932 such that when the motor 938 is energized, smoke is pulled from the smoke box output port 916 to the input port 934, and is subsequently directed out of the output port 936. The connection from the smoke box output port 916 to the blower assembly input port 934 may be made by a plastic or metal tube or any other suitable connecting device. The connection may also be provided by means of a hollow recess within the locomotive.

In the embodiment of FIG. 9, a second blower assembly 906 is provided and is connected to a second smoke box output 918. The motor 948 and fan 942 similarly direct the smoke from the input port 944 to the output port 946. By independently controlling motors 938 and 948, smoke from the smoke box 902 can be selectively directed to a device connected to output port 936 or to a second device connected to output port 946. It should be noted that smoke may also be directed to both output ports 936 and 946 simultaneously by energizing both motor 938 and motor 948. Blower assemblies 904 and 906 may be mechanically integrated into a single structure, or may be mechanically separated.

Figure 10:
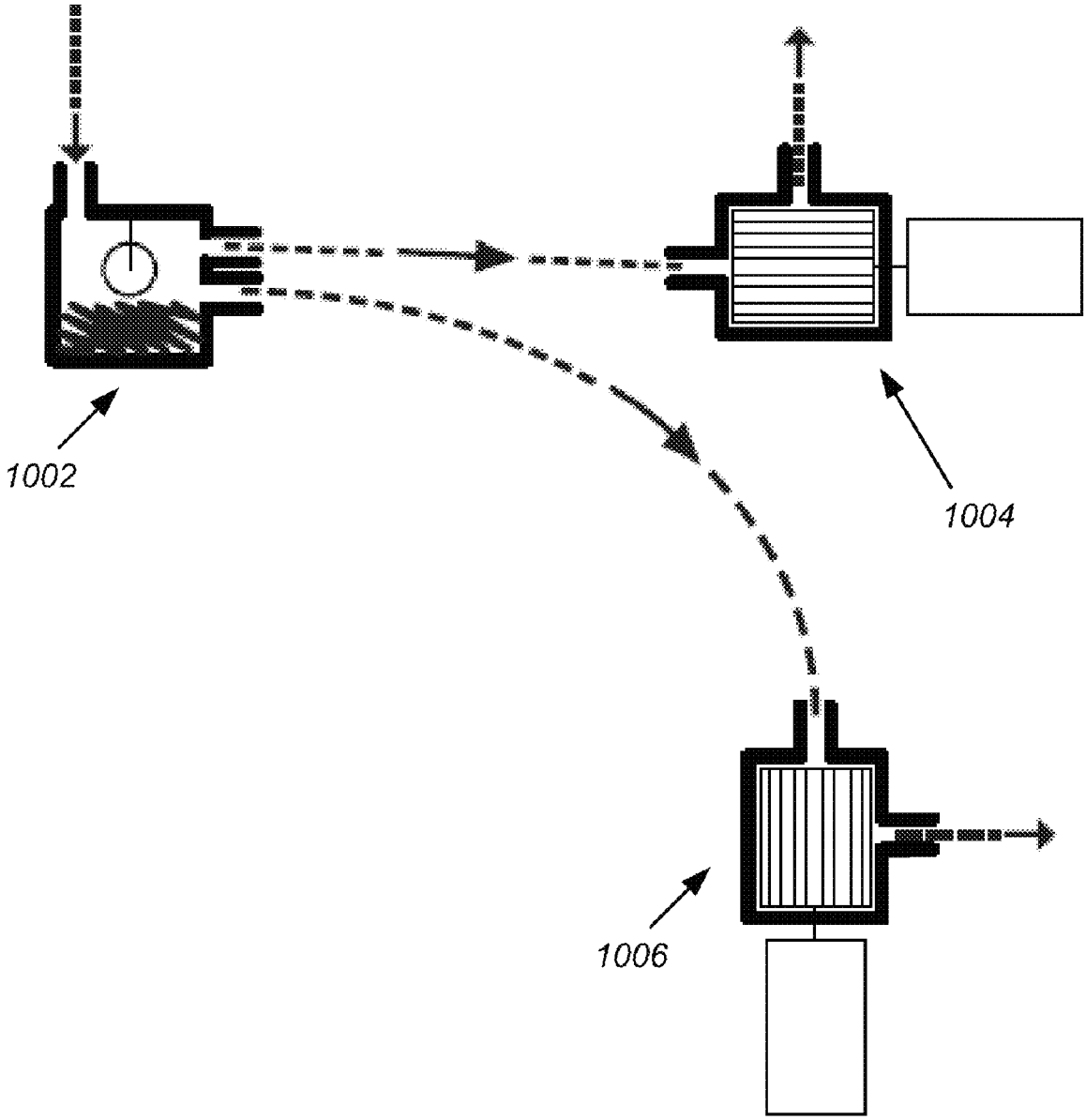
FIG. 10 depicts an alternative embodiment that is similar to that shown in FIG. 9 except that the two blower units are spatially separated from one another.

FIG. 10 illustrates an alternative embodiment of a smoke distribution system in accordance with the present invention. Whereas the two blower units 904 and 906 illustrated in FIG. 9 were shown to be in close proximity with one another or mechanically attached together, it may also be advantageous to separate the blower units, as illustrated in FIG. 10. In this embodiment, a smoke box 1002 is operatively connected to a first blower unit 1004 and a second blower unit 1006 wherein the first blower unit 1004 and the second blower unit 1006 are spatially separated and located in different sections of a model locomotive. For example, the first blower unit 1004 may be located near the smokestack of a model locomotive, while the second unit 1006 may be located near the wheel cylinders.

Figure 11:
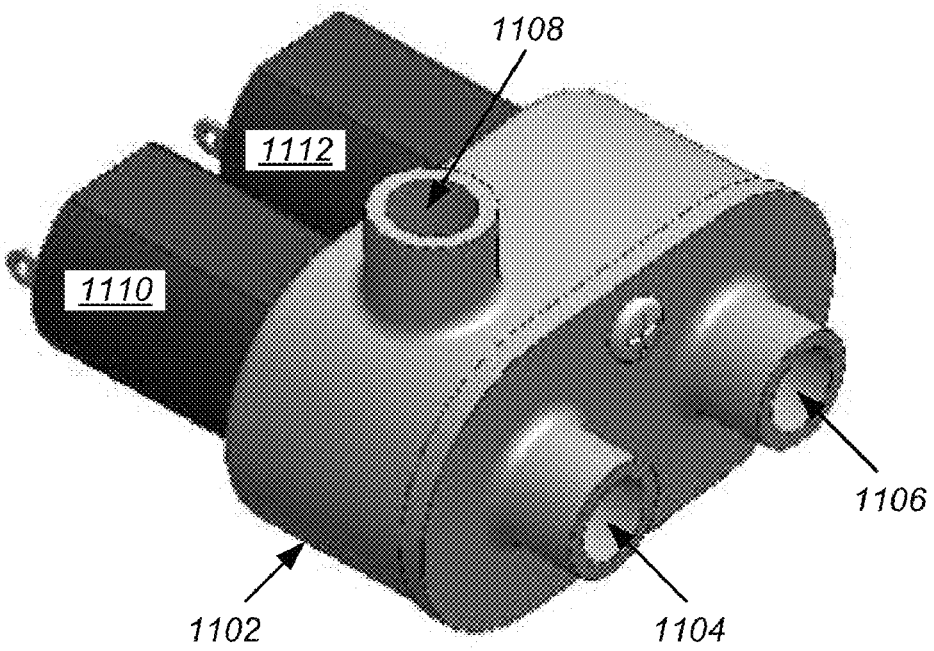
FIG. 11 is a three-dimensional assembly drawing of a dual-blower assembly in accordance with an embodiment of the present invention.

FIG. 11 depicts an embodiment of a dual blower unit, such as that depicted in FIG. 9, comprising elements 904 and 906. Such a unit may be advantageous when space within a model locomotive is limited or when the desired smoke output locations are relatively near one another. In this embodiment, housing 1102 encloses both fan chambers. Input port 1104 draws smoke into the first blower unit while input port 1106 draws smoke into the second blower unit. Output port 1108 from the first blower unit is visible in FIG. 11. The output port of the second blower unit is located on the underside of the housing 1102 and is not visible in this view. Motor 1110 operates a fan inside the first blower unit while motor 1112 operates a fan inside the second blower unit.

Figure 12:
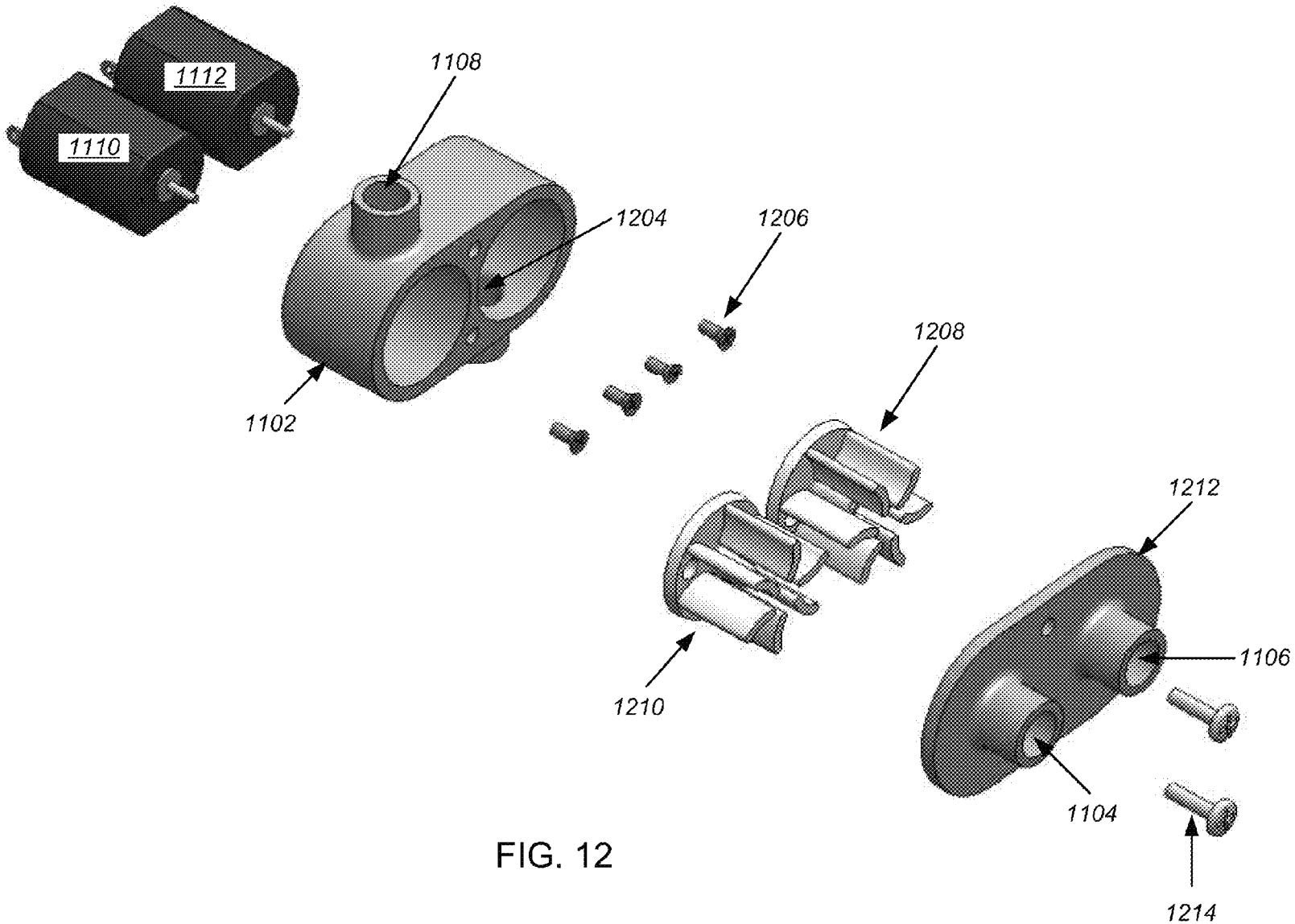
FIG. 12 is an exploded view of the dual-blower assembly depicted in FIG. 11.

FIG. 12 is an exploded view of the dual blower unit depicted in FIG. 11. The output port 1204 of the second blower unit can be seen in this view. Fasteners 1206 secure the motors 1110 and 1112 to the housing 1102. Centrifugal fans 1210 and 1208 are mounted within the openings in the housing 1102 that comprise the first and second blower units. An end cap 1212 including the input ports 1104 and 1106 is secured to the housing 1102 by fasteners 1214.

Figure 13:
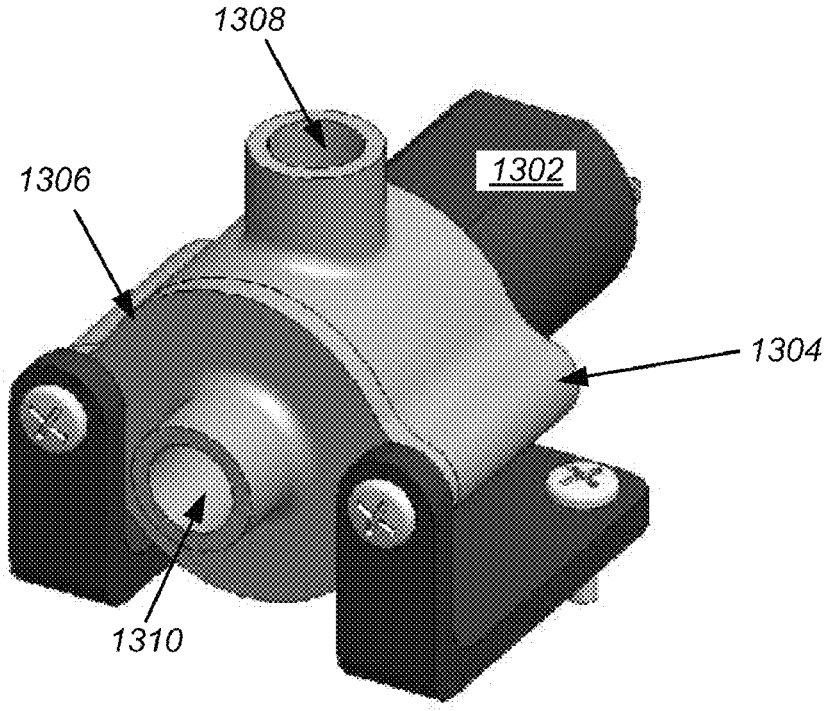
FIG. 13 is a three-dimensional assembly drawing of a single-blower assembly in accordance with an embodiment of the present invention.
Figure 14:
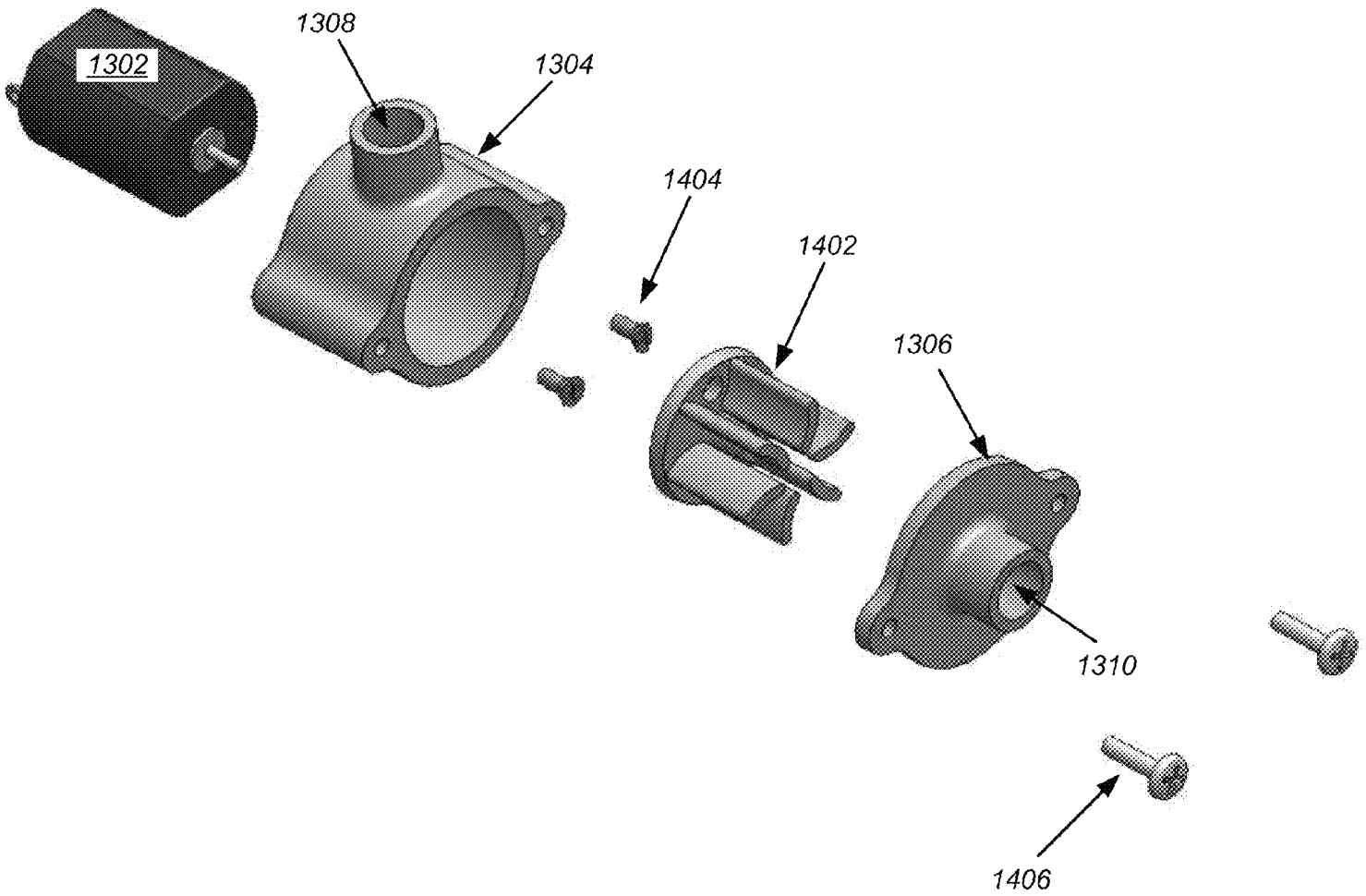
FIG. 14 is an exploded view of the single-blower assembly depicted in FIG. 13.

FIG. 13 is an alternative embodiment of a single blower unit such as that depicted as element 1004 in FIG. 10. Motor 1302 drives a fan located inside housing 1304, having a smoke output port 1308. An end cap 1306 includes an input port 1310. An exploded view of this embodiment is provided in FIG. 14. In FIG. 14, it is evident that housing 1304 is secured to motor 1302 using fasteners 1404 and that centrifugal fan 1402 slides into housing 1304. The end cap 1306 is secured to the housing 1304 using fasteners 1406.

Figure 15:
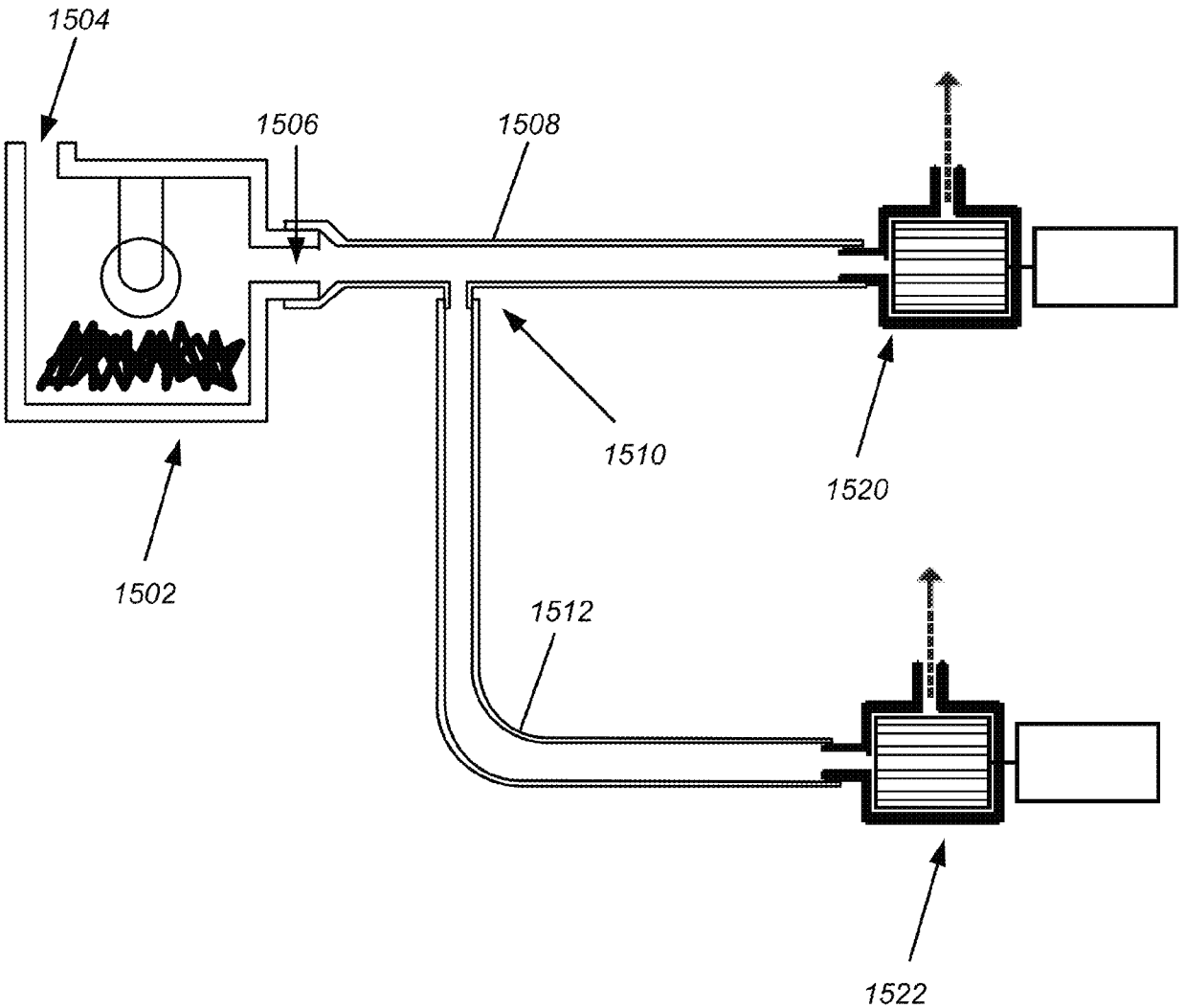
FIG. 15 depicts an embodiment of a smoke-generating system in accordance with the present invention, including a smoke box with a single output connected to two blower units using a tubing assembly having a T-junction.

The embodiments depicted in FIGS. 11-14 are exemplary embodiments and are not intended to limit the scope of the invention in any way. For example, alternative blower configurations, such as those employing propellers rather than centrifugal fans, may be used. Similarly, although single-blower and dual-blower configurations were disclosed, it is also possible to construct embodiments having three or more blowers, and such configurations would also fall within the scope and spirit of the present invention. Multiple-blower systems may be coupled to a smoke unit having a corresponding number of output ports. However, it is also possible to connect a smoke unit having a single output port to multiple blower devices by employing well-known Y-junctions or T-junctions within the tubing connecting the smoke unit to the blowers in order to allow a single smoke unit to drive multiple devices. For example, FIG. 15 illustrates an embodiment of a smoke distribution system in accordance with the present invention that connects a smoke generating unit 1502 having a single input port 1504 and a single output port 1506 to two blower units 1520 and 1522. A first piece of tubing 1508 connects the smoke unit 1502 to the first blower unit 1520. The first piece of tubing 1508 includes a T-junction 1510, allowing a second piece of tubing 1512 to be joined to the first piece of tubing 1508 in order to connect the smoke unit 1502 to the second blower unit 1522.

Figure 16:
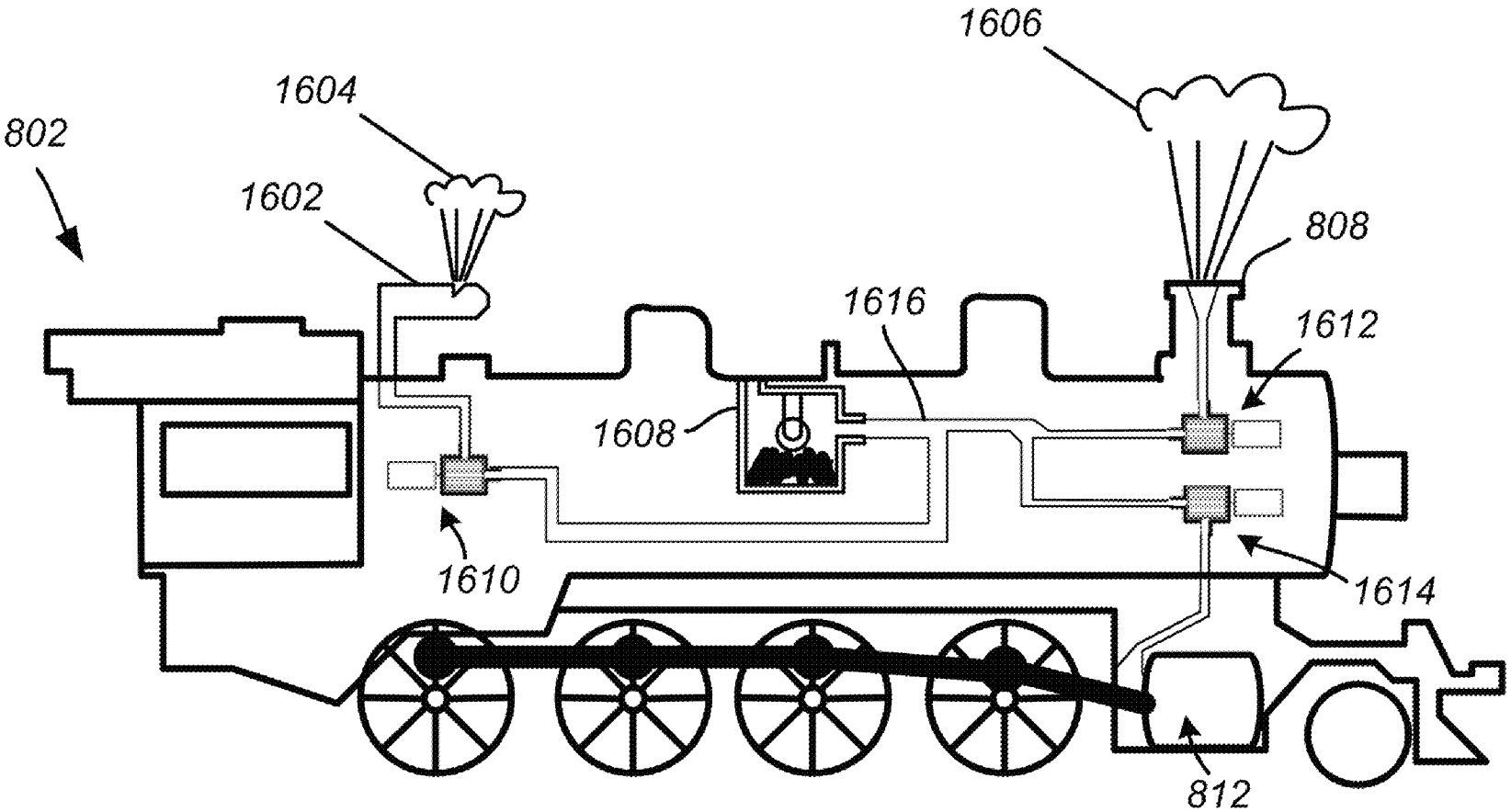
FIG. 16 depicts an embodiment of a smoke-generating system installed in a model vehicle and comprising a smoke box connected to three blower units for directing smoke to a smokestack, a steam whistle, and the wheel cylinders, respectively.

FIG. 16 is an exemplary embodiment of a model train engine 802 including a smoke distribution system in accordance with the present invention that is configured to selectively direct smoke to a smokestack 808, a steam whistle 1602, and to the wheel cylinders 812. A smoke box 1608 includes a heater and a volatizable material applied to wick material within the smoke box. An output of the smoke box is operatively coupled to a distribution system 1616 constructed of plastic tubing, although other types of distribution systems may be used. The distribution system 1616 is connected to a first blower unit 1610, which is in turn connected to a steam whistle 1602. When the motor of the first blower unit 1610 is actuated, smoke from the smoke box 1608 is drawn through the first blower unit 1610 and forced out of the whistle 1602 as indicated at 1604.

Similarly, the smoke distribution system 1616 connects to a second blower unit 1612 and is configured to direct smoke out of the smokestack 808 as indicated at 1606 when the motor connected to the second blower unit 1612 is actuated. The smoke distribution system also connects to a third blower unit 1614, the output of which is routed to a location in the vicinity of the wheel cylinders 812 in order to simulate escaping steam. Of course, a system having more or fewer than three blower units, or one in which the output of blower units were routed to different model features would also fall within the scope and spirit of the present invention.

It may be desirable to couple the generation of smoke with sound effects for increased realism. For example, when smoke is directed to the steam whistle, it may be desirable to simultaneously play a whistle sound effect in order to couple the visual and audio effects. This may be achieved by coupling a sound-effect generator to a smoke controller such that when a particular blower motor is energized, a particular sound effect is initiated. The sound effect may further be made variable, depending on the speed and volume of smoke directed to the model vehicle feature of interest. For example, when a high smoke volume and high rate of speed is initiated for a steam whistle, a loud and high-pitched sound effect may be selected. Alternatively, when a low smoke speed and low smoke volume are directed to the whistle, a softer and perhaps lower pitched whistle sound effect may be selected. The coupling of smoke effects and sound effects may be performed by a processor that automatically adjusts sound effects based upon selected visual smoke effects. Alternatively, for simpler systems, sound generation hardware may be hard wired to certain smoke effects.

Figure 17A:
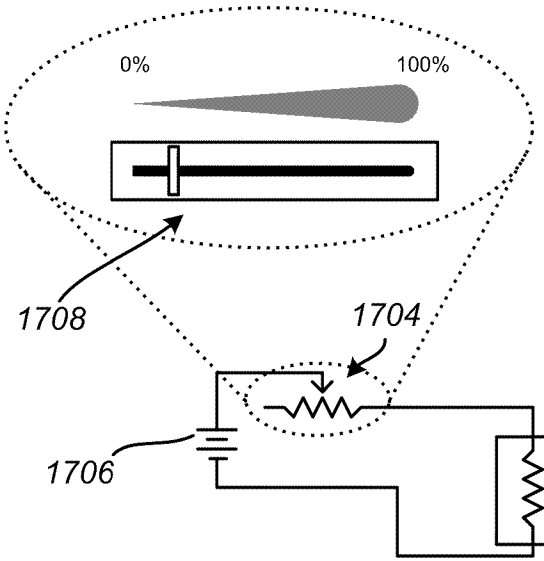
FIGS. 17*a* and 17*b* are simplified schematic drawings of variable control circuits for controlling the volume and speed of smoke distributed throughout a smoke control system in accordance with the present invention.
Figure 17B:
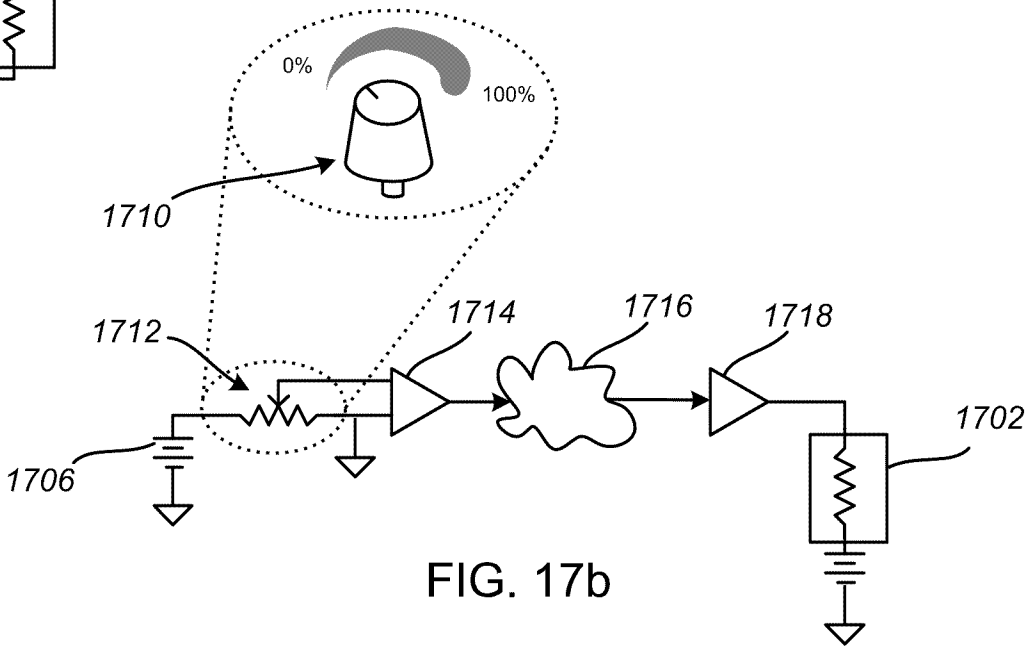

In some applications, it may be desirable to control not only the location of smoke effects but also the speed or volume of smoke produced in order to create more realistic visual effects. FIGS. 17*a* and 17*b* are simplified schematic drawings of exemplary circuits for creating variable smoke volume and speed. FIG. 17*a* depicts an analog direct-control circuit for creating a variable current through a load 1702. The load 1702 may represent a motor winding driven by a power source 1706 with a series variable resistor 1704. As the wiper of the variable resistor 1704 is moved, more or less current is sourced to the motor, causing a change in motor speed and thus fan speed. Such an arrangement allows a user to control the volume and speed of smoke blown out of a model vehicle design feature for increased realism. As indicated in FIG. 17*a*, the variable resistor 1704 may be implemented as a linear slider switch 1708, such that the distance the slider is moved is proportional to the amount of current sourced and thus the speed of the motor.

Alternatively, the load 1702 may represent the heater coils of a smoke box in an embodiment of a smoke-distribution system in accordance with the present invention. In that case, actuating the slide switch 1708 will control the amount of current through and thus the temperature of the heating coils. Increased current will result in increased smoke production, thus providing an alternative approach for variable control of smoke production. In some embodiments, a combination of heater control and motor speed control may be used for enhanced control over smoke production.

FIG. 17*b* depicts an alternative control scheme representing remote variable control of smoke production. In this case, a variable control device 1712 is used to create a voltage reference amplitude that is sampled by transducer 1714. The transducer 1714 then sends the amplitude information across a communication medium 1716 to a receiving transducer 1718. The receiving transducer 1718 controls the current through the load 1702 in accordance with the received amplitude information. The communication medium 1716 may be a radio frequency channel, an infrared channel, a wired channel, such as through the tracks of a model train layout, or any other communication medium known in the art. In the embodiment of FIG. 17*b*, the variable device 1712 is represented by a rotary potentiometer 1710 which produces a change in resistance when a knob is rotated. However, any variable input device known in the art could be used, including both analog and digital control devices. As in FIG. 17*a*, the load 1702 of FIG. 17*b* may represent a motor winding or a smoke-box heater coil, or a combination of both.

Having thus described several embodiments of a system and method for selectively directing smoke in a model vehicle, it should be apparent to those skilled in the art that certain advantages of the system and method have been achieved. It should also be appreciated that various modifications, adaptations, and alternative embodiments thereof may be made within the scope and spirit of the present invention. The invention is solely defined by the following claims.

What is claimed is:

1. A smoke distribution system for a model vehicle comprising:

a smoke generating unit located inside the model vehicle, including:

a housing having an input port and at least one output port;

a volatizable material contained within the housing; and a heating element for applying heat to the volatizable material to create smoke;

a plurality of blower units located inside the model vehicle, each blower unit being physically connected to the other blower units, each blower unit being physically connected to at least a portion of the at least one output port of the smoke generating unit, and each blower unit comprising:

a fan assembly;

a motor assembly operatively coupled to the fan assembly; and a blower housing enclosing the fan assembly and having a smoke input port and a smoke output port; and a control device that can be manipulated between at least three states and is operatively coupled to each one of the blower units;

wherein a first one of the at least three states corresponds to operating the motor assembly of a first one of the plurality of blower units to pull smoke from the smoke generating unit and direct the smoke to the smoke output port of the first one of the plurality of blower units, a second one of the at least three states corresponds to operating the motor assembly of a second one of the plurality of blower units to pull smoke from the smoke generating unit and direct the smoke to the smoke output port of the second one of the plurality of blower units, and a third one of the at least three states corresponds to operating the motor assemblies of both the first and second ones of the plurality of blower units to pull smoke from the smoke generating unit and direct the smoke to the smoke output ports of the first and second ones of the plurality of blower units; and wherein the plurality of blower units are configured to route smoke from inside the model vehicle to outside the model vehicle.

2. The smoke distribution system of claim 1, wherein:

the smoke generating unit has two output ports; and wherein one of the two output ports is connected to the smoke input port of a first one of the plurality of blower units and the other one of the two output ports is connected to the smoke input port of a second one of the plurality of blower units.

3. The smoke distribution system of claim 2, wherein:

the smoke generating unit has one output port; and wherein the output port is connected both to the smoke input port of a first one of the plurality of blower units and to the smoke input port of a second one of the plurality of blower units using a tube assembly including at least one junction coupling.

4. The smoke distribution system of claim 3, wherein the plurality of blower units are arranged as an integrated mechanical assembly wherein a first blower unit is mechanically connected to a second blower unit, such that the first blower unit can be operated independently of the second blower unit.

5. The smoke distribution system of claim 1 wherein the smoke distribution system is installed within a model train engine having a model steam whistle and further wherein one of the plurality of blower units is operatively connected to the model steam whistle such that smoke can be selectively directed through the model steam whistle.

6. The smoke distribution system of claim 1, wherein the model vehicle further includes a sound generating system configured to produce an audio effect at the same time one of the plurality of blower units is selectively operated.

7. The smoke distribution system of claim 6, wherein the model vehicle further includes a model steam whistle operatively coupled to one of the plurality of blower units and the audio effect comprises a steam whistle audio effect that is played when the one of the plurality of blower units is operated to direct smoke to the model steam whistle.

8. The smoke distribution system of claim 1, wherein the control device is a variable control device operatively coupled to each one of the plurality of blower units and configured to control a speed of the motor assembly of each of the plurality of blower units.

9. The model vehicle system of claim 8, wherein the variable input device comprises at least one of a variable linear sliding switch, a variable rotating switch, and a variable digital controller circuit.

10. The smoke distribution system of claim 1, further comprising a variable input device adapted to control an amount of current supplied to the heating element of the smoke generating unit.

11. The smoke distribution system of claim 10, wherein the variable input device comprises at least one of a variable linear sliding switch, a variable rotating switch, and a variable digital controller circuit.

* * * * *